US006796909B2

(12) United States Patent
Pribyl

(10) Patent No.: US 6,796,909 B2
(45) Date of Patent: Sep. 28, 2004

(54) MOBILE DEVICE FOR PRACTICING GOLF BALL STROKES

(76) Inventor: Zdenek Pribyl, Okruzni 691, Maratice, 686 05 Uherske Hradiste (CZ)

( * ) Notice: Subject to any disclaimer, the term of this patent is extended or adjusted under 35 U.S.C. 154(b) by 0 days.

(21) Appl. No.: 10/469,196

(22) PCT Filed: Jan. 9, 2002

(86) PCT No.: PCT/CZ02/00002

§ 371 (c)(1),
(2), (4) Date: Dec. 15, 2003

(87) PCT Pub. No.: WO02/085470

PCT Pub. Date: Oct. 31, 2002

(65) Prior Publication Data

US 2004/0072624 A1 Apr. 15, 2004

(30) Foreign Application Priority Data

Apr. 23, 2001 (CZ) ..... 2001-1435

(51) Int. Cl.[7] ..... A63B 69/36
(52) U.S. Cl. ..... 473/139; 242/387
(58) Field of Search ..... 473/423, 424, 473/425, 426, 427, 428, 429, 430, 138–149; 242/225, 228, 387

(56) References Cited

U.S. PATENT DOCUMENTS 2,714,009 A 7/1955 Noland ..... 273/200
2,737,393 A 8/1956 Simjian ..... 273/185
3,191,880 A * 6/1965 Visconti ..... 242/386
3,707,268 A 12/1972 Kelly ..... 242/54
3,735,934 A 5/1973 Black ..... 242/54
3,826,439 A * 7/1974 Moon ..... 473/142
3,876,162 A * 4/1975 Chun et a. ..... 473/142
4,240,592 A * 12/1980 Russo ..... 242/387
5,431,404 A 7/1995 Kotecki ..... 273/185
5,853,334 A * 12/1998 Winebrenner ..... 473/142
6,343,996 B1 * 2/2002 Gasseling ..... 473/147

* cited by examiner

*Primary Examiner*—Steven Wong
*Assistant Examiner*—Nini F. Legesse
(74) *Attorney, Agent, or Firm*—Ladas & Parry

(57) ABSTRACT

A mobile device for practicing golf ball strokes, the mobile device resting on a base (1), onto which a cabinet (3) is attached by means of a mounting (2), the cabinet (3) housing a reel (4) provided with a brake (5), a cord (6) and a switch lever (7) connected with a control and guiding rod (8), the reel (4) being equipped with a motor (9) connected to the control unit (10) incorporating a source (11) and a display (12), with the cord (6) passing at the exit from the cabinet (3) through a sensing unit (13) connected with the control unit (10), with the ball (14) being attached in a rotary manner at the end of the cord (6).

1 Claim, 1 Drawing Sheet

MOBILE DEVICE FOR PRACTICING GOLF BALL STROKES

FIELD OF THE INVENTION

This invention relates to a portable device with an automated return of the ball designed for practicing golf ball strokes in a limited space of various terrains as well as outside golf courses.

DESCRIPTION OF THE PRIOR ART

The present golf stroke training and teaching methods permit a simple practice of ball shots using common means outside golf courses only to a limited extend and with low efficiency. For economic reasons, practice balls of unsuitable properties are used and the balls, after having been shot off, must be sought out and collected for a repeated use. Time and material losses involved in this method are evident. In addition, only separate strokes can be practiced in this way while complex play situations must be practiced directly in golf courses outside the driving range, which is not easy to do for amateurs.

NATURE OF THE INVENTION

The above shortcomings and disadvantages of the means for practicing golf ball shots known until now are eliminated by a mobile device for practicing golf ball strokes according to this invention. The nature of the invention can be described as follows: the device rests on a base onto which a cabinet is attached by means of a mounting. The cabinet houses a reel provided with a brake, a cord and a switch lever connected with a control and guiding rod. The reel is equipped with a motor connected to a control unit incorporating a source and a display, with the cord at the exit from the cabinet passing through a sensing unit connected with the control unit, and a ball being attached in a rotary manner at the end of the cord.

Advantageously, the device for practicing golf ball strokes according to this invention has a ball containing a sleeve, through which the cord passes ending with a spherical stop having a diameter exceeding the inside diameter of the sleeve.

The reel motor control of the device according to this invention can be provided with a direct or a remote controller.

Advantageously, the device according to this invention can be mounted on the base by means of a ball joint with the upper surface of the cabinet being provided with a cross level.

BRIEF DESCRIPTION OF THE DRAWINGS

Embodiment of the device for practising golf ball strokes is illustrated in the attached drawing, of which.

INVENTION EMBODIMENT

Figure 1:
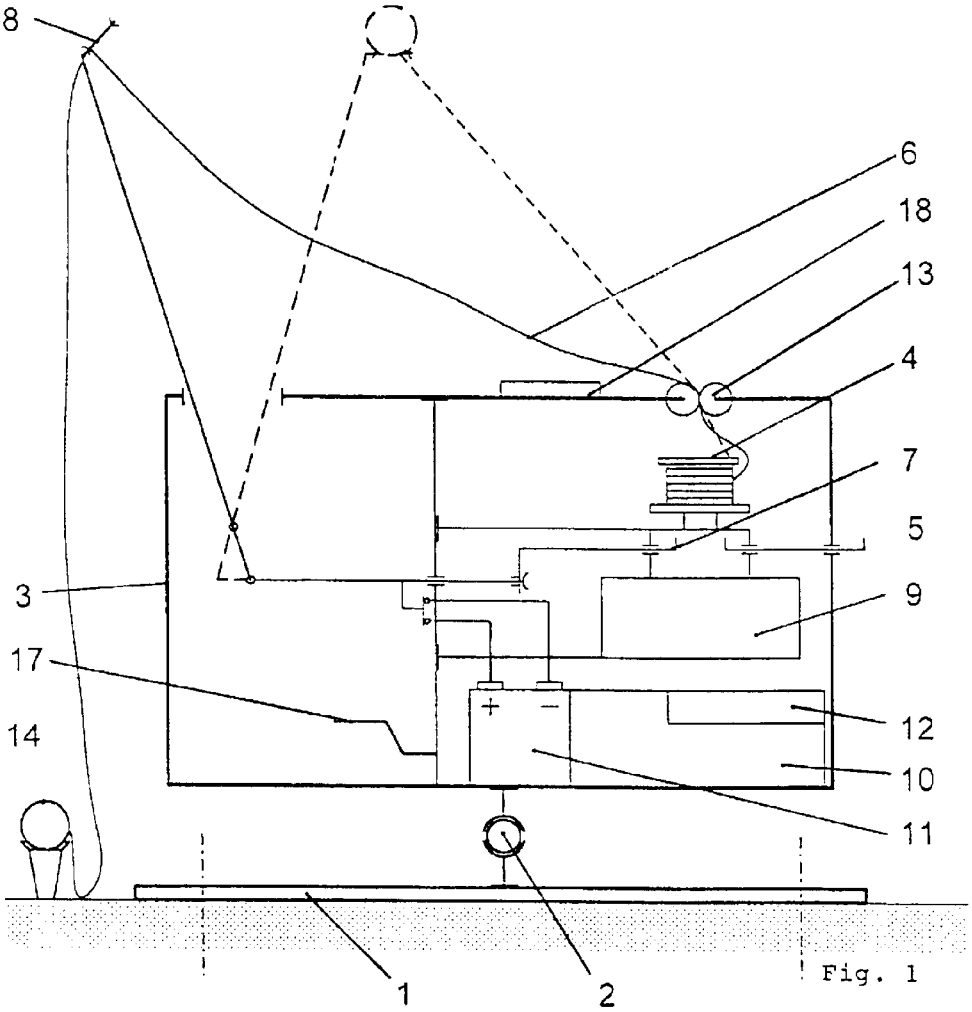
FIG. 1 shows a diagram of the device in elevation.
Figure 2:
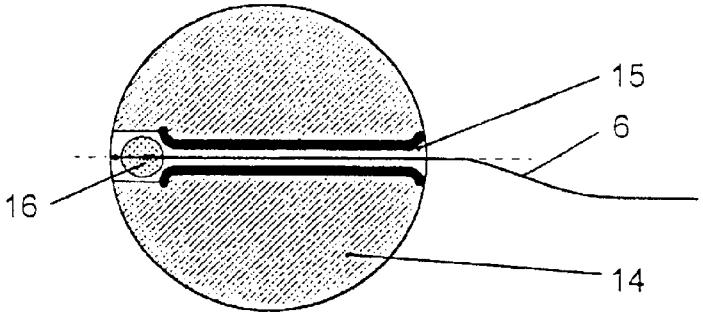
FIG. 2 shows a design of the ball with the cord and the sleeve (cross-section).

From the enclosed drawing (FIG. 1) it is apparent that the illustrated device rests on a base 1, onto which a cabinet 3 is attached by means of a mounting 2,—a ball joint here. The cabinet 3 houses a reel 4 provided with brake 5, cord 6 and switch lever 7. For service, the switch lever 7 is connected with a control and guiding rod 8. In order to enable wind-up of the cord 6 the reel 4 is equipped with a motor 9 connected to the control unit 10, which is provided with a source 11 and a display 12. At the exit from the cabinet 3, the cord 6 passes through a sensing unit 13, which is connected to the control unit 10. At the end of the cord 6 a ball 14 is attached in a fashion allowing rotation of the ball 14. The ball contains a sleeve 15, through which the cord 6 passes ending with a spherical stop 16 having a diameter exceeding the inside diameter of the sleeve 15. A controller 17 connected to the control of motor 9 of the reel 4 serves for manual control of return of the ball 14. The direct controller 17 can be connected with a guiding and control rod 8. The upper surface of the cabinet 3 is provided with a cross-level 18.

At the stroke of the ball 14 also the cord 6 is set to motion with the cord 6 unwinding freely from the reel 4 during the flight of the ball 14. The unwinding is made possible by moving the control and guiding rod 8 from the left (illustrated with a solid line in FIG. 1) to the right (illustrated with a dashed line) and by making a corresponding change in the position of the switch lever 7. However, the return movement of the control and guiding rod 8 to the left made prior to a stroke of the ball takes place without the change in the position of the switch lever 7. Movement of the cord 6 through the sensing unit 13 actuates, via the control unit 10, the motor 9 driving the reel 4. When the set distance—the flight path of the ball 14—length of the unwound section of the cord 6—has been reached the control unit 10 actuates the brake 5, which can be set to the strength of the cord 6 to prevent rupture of the cord by slippage. After the ball 14 has stopped, the control unit 10 releases the brake 5, changes the position of the switch lever 7 by means of the motor 9 and starts to wind up the cord 6 onto the reel 4. This will cause an automatic return of the ball 14 to the control and guiding rod 8, which will move to the position on the right (depicted with a dashed line in FIG. 1) and switch off the motor 9 when the end position of the ball 14 has been reached while releasing simultaneously the reel 4 with wound-up cord 6 for further stroke using the switch lever 7. The control and guiding rod 8 is returned to the position on the left (illustrated with the solid line in FIG. 1) causing no return movement of the switch lever 7. The return movement is initiated by the control unit 10 only prior to new wind-up of the cord 6 onto the reel 4.

The sensing unit 13 records movement of the cord 6 and based on the parameters obtained the control unit 10 determines the anticipated distance of the flight of the ball 14 in real conditions, which means at unshortened flight path. Then this flight path of the ball 14 including statistics of strokes with respect to the number and kind of the golf club selected is shown on the display 12 of the training device. From the measurement and evaluated data the control unit 10 then also obtains further interesting information such as speed course of the ball 14 or other above standard information, depending on the software used. Also, the final position of the ball 14 after the cord 6 is fully wound up can be affected directly by earlier termination of winding and placing the ball 14 directly into the position for further stroke, which can be achieved by the software used.

The main advantage of the device for practising golf ball shots according to the present invention is the possibility to practise golf strokes in limited conditions, in various, even less suitable or publicly accessible terrains including water expanses. This eliminates the main difficulty in teaching golf game, namely unavailability of suitable practice conditions and terrain and high practising costs. A great advantage in terms of both time and economy is the automatic return of the ball. Therefore, a standard golf ball of a corresponding quality can be used. The cord of a minimum cross-section unwound freely from the reel permitting rotation of the ball will affect, with respect to other acting forces, the ball flight path very little only. The display of the ball flight trajectory in real conditions is a significant advantage of the device according to the present invention. A major advantage for user is also a low weight and easy handling of the device.

What is claimed is:

1. A mobile device for practicing golf ball strokes equipped with a ball (14) attached to a cord (6) with a sensing unit (13) wound on a reel (4) equipped with a motor (9), a brake (5) and a switch lever (7), characterized in that a cabinet (3) is attached adjustably through a ball joint (2) onto a base (1), an upper surface of the said cabinet (3) being provided with a level (18), and further that the ball (14) is attached in a rotary manner to the cord (6) passing through a sleeve (15) incorporated in the ball (14), the cord (6) being terminated with a spherical stop (16), and further that a display (12) for displaying path and place of landing of the ball (14) or the ball velocity recorded or evaluated by a control unit (10), the display (12) is connected with the control unit (10)-incorporating a source (11), the control unit (10) being intended to ensure an automatic return of the ball (14), and further that the switch lever (7) of the reel (4) is provided with a control and guiding rod (8) and the control of the motor (9) of the reel (4) is equipped with a direct controller (17).

* * * * *